United States Patent [19]

Schultz

[11] Patent Number: 5,013,198

[45] Date of Patent: May 7, 1991

[54] AIR-HYDRAULIC PUMP WITH AUXILIARY PUMPING MEANS

[76] Inventor: Richard A. Schultz, 1491 Inlynd Dr., Sullivan, Wis. 53178

[21] Appl. No.: 278,010

[22] Filed: Nov. 30, 1988

[51] Int. Cl.[5] ..... F04B 3/00

[52] U.S. Cl. ..... 417/287; 417/403; 417/487

[58] Field of Search ..... 417/426, 427, 428, 429, 417/401, 403, 487, 287

[56] References Cited

U.S. PATENT DOCUMENTS

| | | | |
|---|---|---|---|
| 1,674,614 | 6/1928 | Berkman | 417/403 |
| 2,820,415 | 1/1958 | Born | 417/287 |
| 2,949,080 | 8/1960 | Ottestad | 417/401 |
| 3,053,435 | 9/1962 | Sanders et al. | 417/403 |
| 3,112,705 | 12/1963 | Chlebowski | 417/487 X |
| 3,775,027 | 11/1973 | Craft | 417/487 X |
| 3,825,122 | 7/1974 | Taylor | 417/377 X |
| 4,198,844 | 4/1980 | Lowe et al. | 92/13.8 X |
| 4,494,398 | 1/1985 | Svoboda | 72/393 |

OTHER PUBLICATIONS

Mitey Mate—II service manual.
Enerpac E-316 Catalog, p. 42.

*Primary Examiner*—Leonard E. Smith
*Attorney, Agent, or Firm*—Andrus, Sceales, Starke & Sawall

[57] ABSTRACT

An air-hydraulic pump incorporates a primary pumping mechanism for supplying a first level of fluid pressure to a work-performing tool at a first flow rate in response to a supply of pressurized air. An auxiliary pumping mechanism is provided for delivering a second level of hydraulic fluid pressure less than the first level at a flow rate greater than the first flow rate. The auxiliary pumping mechanism provides sufficient pressure to overcome a load on the system up to a predetermined level, after which the auxiliary pumping mechanism ceases operation due to such load and the primary pumping mechanism delivers fluid pressure to the system sufficient to overcome the load. The auxiliary pumping mechanism speeds up operation of the work-performing tool for providing time-saving operation thereof.

17 Claims, 7 Drawing Sheets

AIR-HYDRAULIC PUMP WITH AUXILIARY PUMPING MEANS

BACKGROUND AND SUMMARY

This invention relates to pressurized air operated hydraulic equipment, and more particularly to an air-hydraulic pump.

As is known, an air-hydraulic pump delivers hydraulic fluid pressure in response to a supply of pressurized air. Air-hydraulic pumps are well known and used in many applications, one of which is to provide fluid pressure to an expander for expanding a pipe or the like. Such a tool is commonly employed to expand the end of a cut-off exhaust pipe for installing a replacement muffler in the exhaust system of an automobile by connection to the exhaust pipe. In applications such as this, it is necessary for the air-hydraulic pump to deliver a high level of pressure to the pipe expander in order to overcome the large load placed thereon by the unexpanded pipe.

Prior art air-hydraulic pumps deliver a constant amount of pressure to a hydraulic system, regardless of the load on the system. As a result, in a pump designed to deliver high fluid pressure, the flow rate or volume of hydraulic fluid pumped through the system is relatively low. Such low volume, high pressure pumping of fluid results in a relatively slow speed of operation of the expanding tool. In some instances, for example when the stem of the expanding tool must be withdrawn a certain amount prior to causing the expandable sleeve to make contact with the inner surface of the pipe, such slowness of operation results in wasted time of the operator and an overall inefficient operation. Further, such an operation is typically performed overhead, and maintaining the expander in position for an extended period of time is a difficult task, due to the weight of the expander.

Other applications of an air-hydraulic pump entail the same or similar inefficiencies of operation resulting from slow movement of a hydraulically operated member which requires a high level of pressure in order to perform its task.

The present invention addresses the above-noted problem in operation of an air-hydraulic pump, and provides a means for reducing the amount of time necessary for the work-performing element of the hydraulic system to attain a certain predetermined level of load thereon which requires a relatively high level of hydraulic pressure delivered to the work-performing element for overcoming such load. The present invention provides an air-hydraulic pump having relatively high, level of pressure to the work-performing element of the hydraulic system for overcoming the predetermined load exerted thereon. As discussed above, the high level of pressure results in a low flow rate of fluid through the system. The invention provides an auxiliary pumping means for delivering a second, relatively low, level of pressure to the work-performing element at a relatively high flow rate for increasing the speed at which the work-performing element operates prior to exertion of the predetermined load thereon. Once the predetermined load is exerted on the system, the auxiliary pumping means ceases operation due to exertion of the predetermined load on the system, and the primary pumping means then delivers the first level of pressure to the system in order to overcome the predetermined load.

In one embodiment, the primary pumping means comprises a piston having a head and a rod, with the head being selectively exposed to pressurized air through a control means for providing reciprocating movement of the piston. Such reciprocating movement of the piston rod provides pumping of hydraulic fluid by the piston rod end for delivering a high level of hydraulic pressure to the system at a relatively low volume. The auxiliary pumping means preferably comprises a floating ring, or floating piston, slidably mounted to the piston rod and having a hydraulic fluid contact surface and a surface exposed to pressurized air. The hydraulic fluid contact surface provided on the floating ring is greater than the hydraulic fluid contact surface of the piston rod end. Through the control means, reciprocating movement of the floating ring is provided for pumping fluid through the system at a relatively high flow rate, delivering a second level of fluid pressure to the system lower than the first level delivered by the reciprocating action of the rod end. When a predetermined level of load is exerted on the hydraulic system, the force exerted on the floating ring due to fluid pressure on the hydraulic fluid contact surface exceeds the force exerted on the ring by pressurized air on the surface of the floating ring exposed thereto, so that further reciprocating movement of the floating ring is prevented. In this situation, reciprocating movement of the piston continues, so that the piston rod end continues to deliver the first level of fluid pressure to the system.

The air-hydraulic pump of the invention preferably comprises an air intake block, a control block and a hydraulic block. A first cavity is preferably provided between the air intake block and the control block, within which the piston head is preferably disposed. A second cavity is preferably provided between the control block and the hydraulic block. The piston rod preferably extends through the control block and into the second cavity, within which the floating ring is preferably disposed. The hydraulic block includes passages with which the hydraulic system is in communication, so that hydraulic fluid pressure is provided therethrough to the system in response to reciprocating movement of the floating ring and/or the piston rod end.

The control means provided in the control block preferably includes means for selectively providing fluid pressure to the faces of the piston head or the surface of the floating ring exposed to pressurized air through the control means, for selectively providing reciprocating movement thereof. The control means preferably includes sensing means for detecting air pressure on the piston head faces, and means responsive to the sensing means for selectively providing pressurized air thereto and to the surface of the floating ring exposed to pressurized air through the control means for providing reciprocating movement of the piston head. The means responsive to the sensing means preferably comprises a series of passages formed in the control block in communication with one of the piston head faces and with the surface of the floating ring exposed to pressurized air, and passage means for providing pressurized air to the other face of the piston head. A spool member is mounted within a spool passage formed in the control block for reciprocating movement, to selectively provide pressurized air to such surfaces for reciprocating the piston and thereby providing fluid pressure in the hydraulic system.

The invention further provides a hand held work performing tool for use in connection with a hydraulic fluid system, with actuator means provided on the hand held tool for selectively providing pressurized air to the control means and thereby fluid pressure to the hydraulic system. The actuator means preferably comprises a normally closed air valve in communication with the supply of pressurized air, with the air valve being movable to an open position for providing pressurized air thereto and thereby operating the control means.

BRIEF DESCRIPTION OF THE DRAWINGS

The drawings illustrate the best mode presently contemplated of carrying out the invention.

In the drawings.

DETAILED DESCRIPTION OF THE PREFERRED EMBODIMENT

Figure 1:
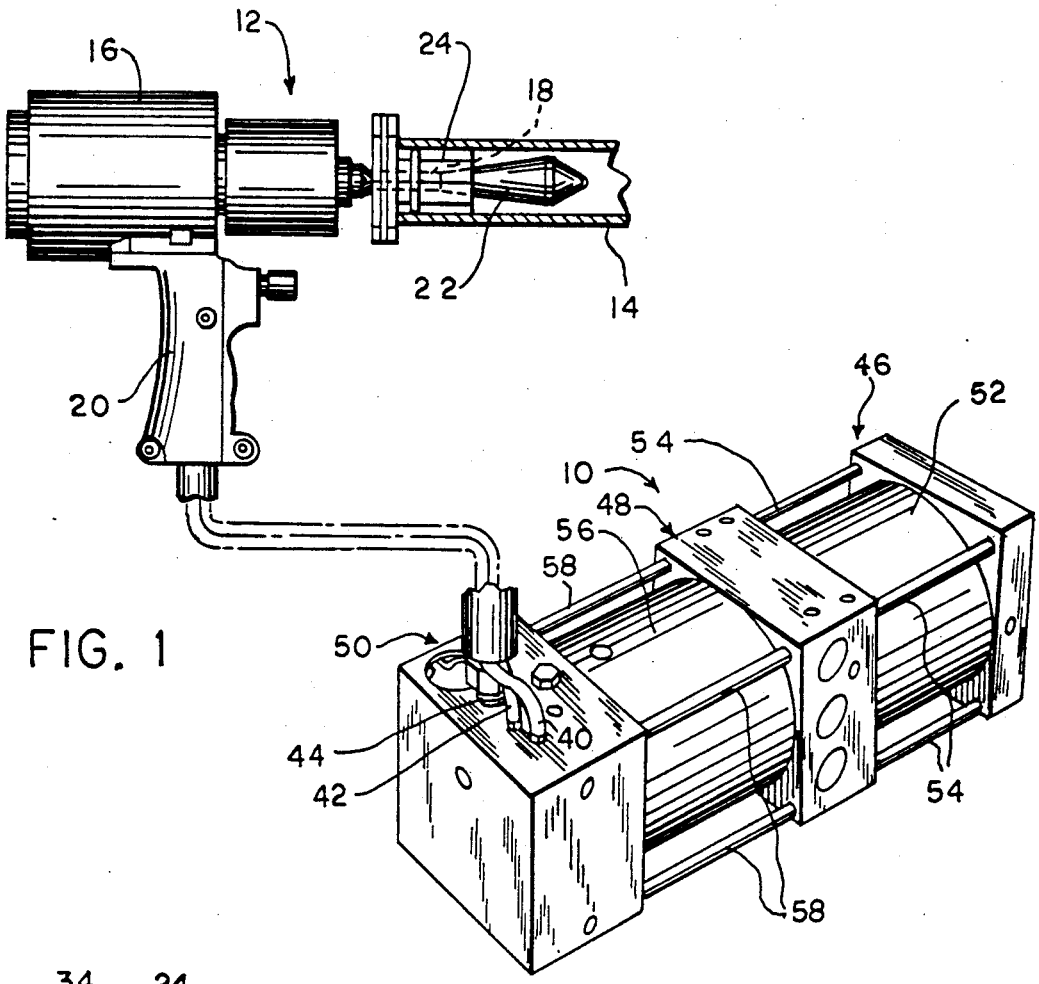
FIG. 1 is a view illustrating an air-hydraulic pump constructed according to the invention and a pipe expanding tool connected thereto.

As shown in FIG. 1, an air-hydraulic pump 10 constructed according to the invention is illustrated in conjunction with a pipe expanding tool 12 for use in expanding the end of a pipe 14. Pipe expander 12 includes a body portion 16 to which an axially extending stem 18 is slidably mounted, and a handle portion 20. As is known, stem 18 terminates in a conical portion 22, and a segmented expanding ring 24 is mounted to stem 18. Segmented ring 24 is placed within pipe 14 so that its outer surfaces are closely adjacent the inner surface of pipe 14.

Figure 2:
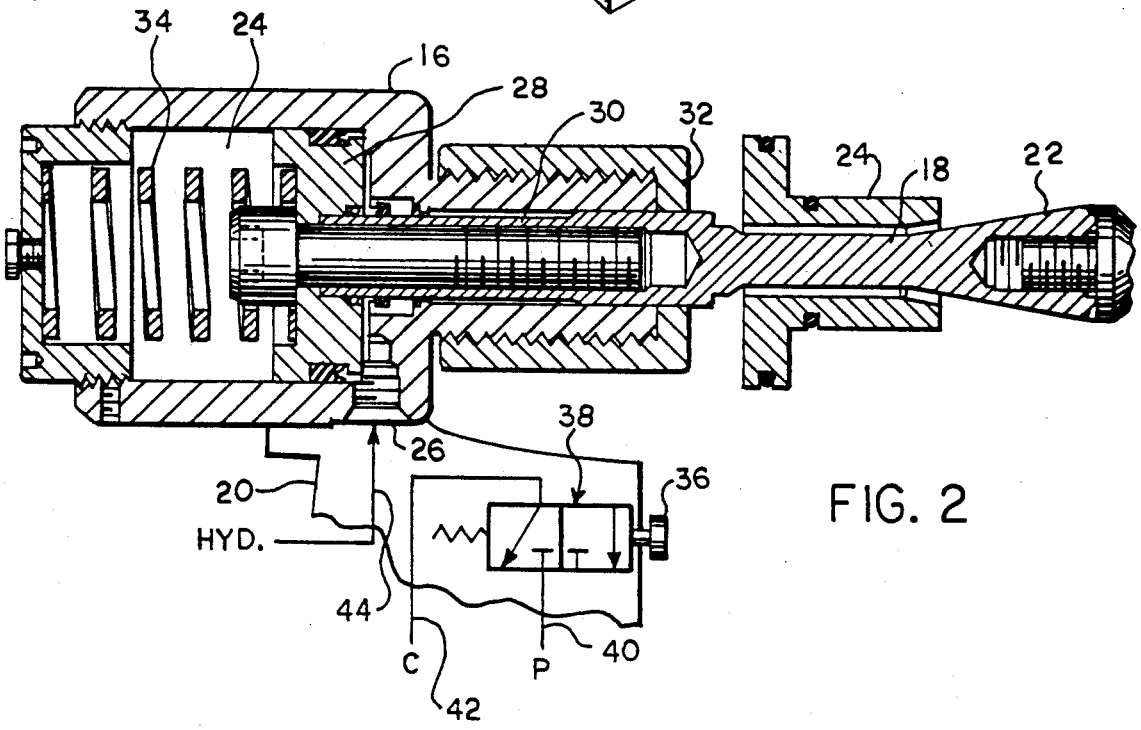
FIG. 2 is a sectional view through the pipe expanding tool for use with the air-hydraulic pump of the invention.

Through known operating principles, hydraulic fluid pressure is introduced to a cavity 24 provided in body portion 16 through a port 26 so as to cause axial leftward movement of a piston 28 therewithin. Such movement of piston 28 is transferred through a sleeve 30 so as to cause withdrawal of stem 18 into body portion 16. Axial leftward movement of segmented ring 24 is prevented by an abutting surface 32 provided at the rightward end of body portion 16, whereafter continued withdrawal of stem 18 into body portion 16 causes conical end portion 22 of stem 18 to engage the inner surfaces of segmented ring 24 so as to cause expansion thereof. Continued such movement of conical portion 22 expands the diameter of the end portion of pipe 14 due to expansion of the transverse dimension of segmented ring 24 by movement of conical portion 22 therethrough. A spring 34 returns piston 28 to its original position after release of hydraulic fluid pressure on the rightward face thereof, causing expulsion of hydraulic fluid through port 26 and return of expander 12 to its original position as shown in FIG. 2.

In the past, expander 12 has been operable by means of a foot operated air-hydraulic pump for supplying hydraulic pressure to port 26. By the present invention, however, an actuator button 36 is provided on handle 20 of expander 12 for easing operation by a user. Actuator button 36 is interconnected with a normally closed air valve which is in communication with a pressurized air control system for operating air-hydraulic pump 10. With reference to FIG. 2, such a normally closed air valve is shown schematically at 38, with pressurized air being supplied thereto through a pressure line 40. A control line 42 is in communication with valve 38 so that, upon depression of button 36 and movement of valve 38 to its open position, pressurized air is supplied from line 40 through valve 38 to control line 42. Air pressure in control line 42 actuates the control system of air-hydraulic pump 10, resulting in hydraulic fluid being introduced through a hydraulic fluid line 44 to port 26, and thereby to piston 28. Details of the air-hydraulic system which causes hydraulic fluid to be introduced to hydraulic line 44 by supply of pressurized air from pressure line 40 to control line 42 through valve 38 will subsequently be explained.

With reference to FIG. 1, air-hydraulic pump 10 includes an air intake block 46, a control block 48, and a hydraulic block 50. A cylindrical outer air tube 52 is disposed between air intake block 46 and control block 48, with one end of tube 52 abutting air intake block 46 and the other end of tube 52 abutting control block 48. A series of bolts 54 extend between air intake block 46 and control block 48 for assembling air intake block 46, control block 48 and tube 52.

A cylindrical outer oil tube 56 is disposed between control block 48 and hydraulic block 50, with one end of tube 56 abutting control block 48 and the other end abutting hydraulic block 50. A series of bolts 58 extend between control block 48 and hydraulic block 50 for assembling control block 48, tube 45 and hydraulic block 50.

Figure 3:
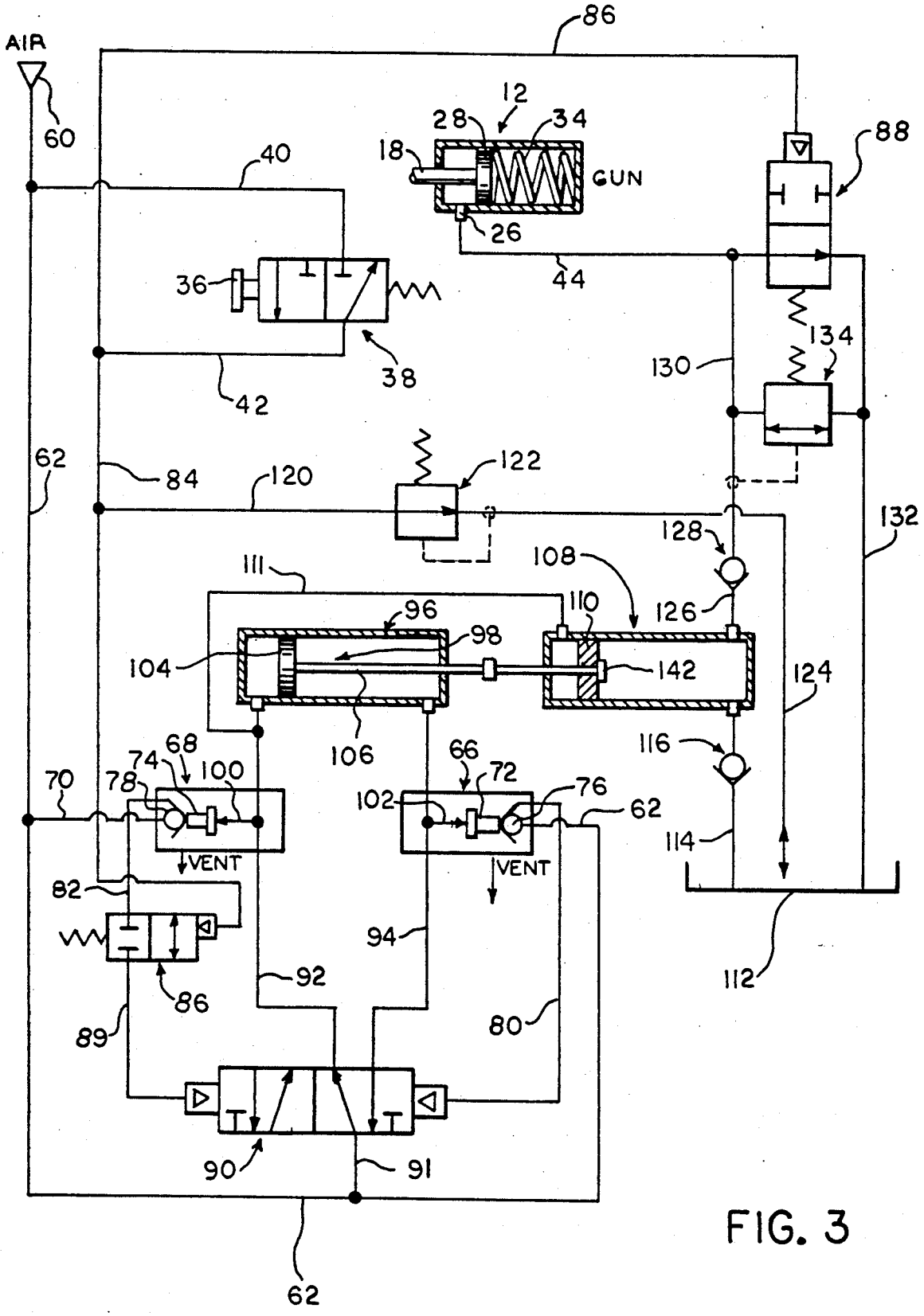
FIG. 3 is a schematic diagram showing the circuitry of the pressurized air and hydraulic system of the invention, with the elements thereof shown in an inoperative position.
Figure 4:
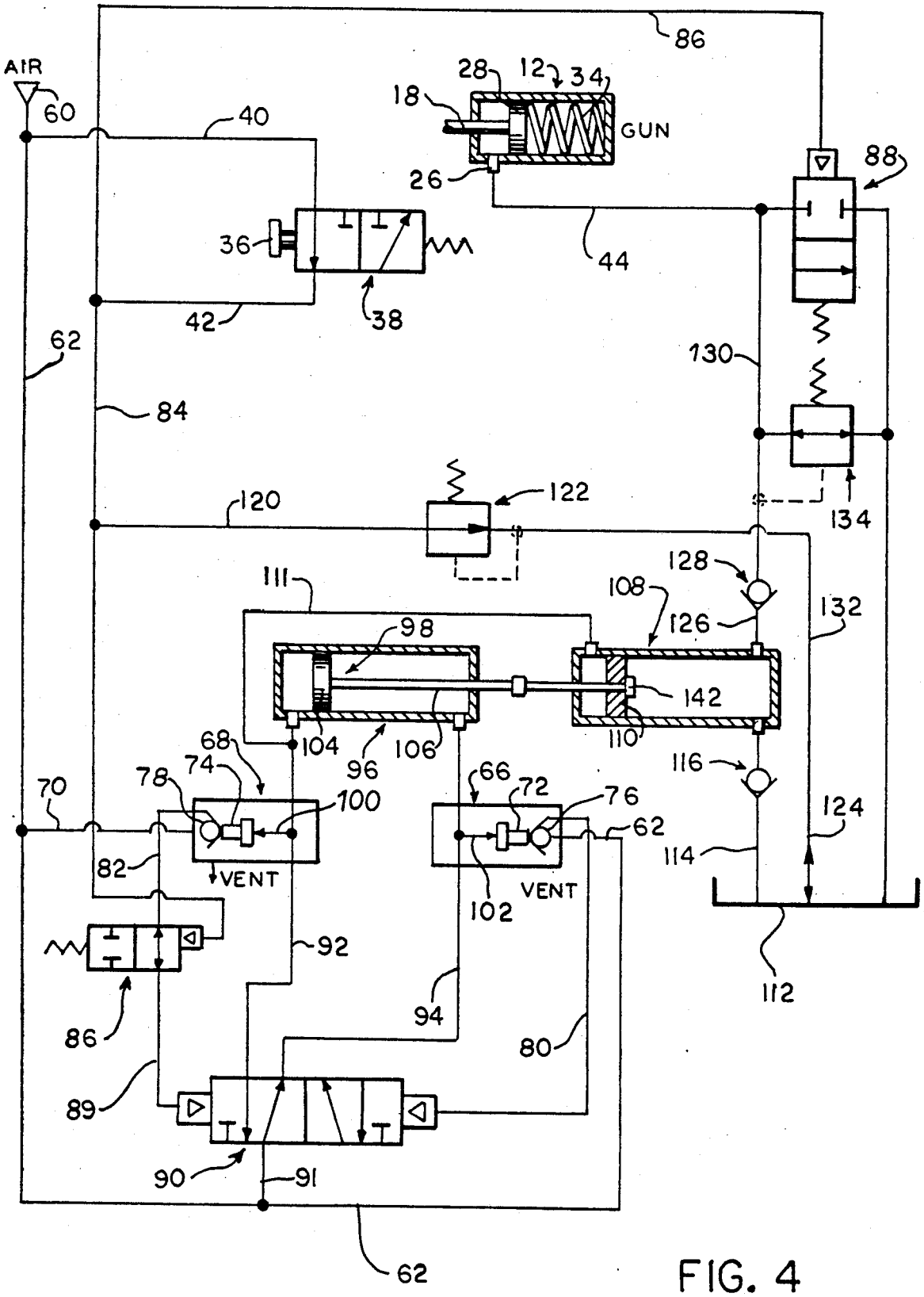
FIG. 4 is a view similar to FIG. 3, showing the elements of the pressurized air and hydraulic system of the invention in an operative position.

Reference is now made to FIGS. 3 and 4, which illustrate schematically pressurized air hydraulic pump 10 of the invention. As shown in FIG. 3, with the components of pump 10 in their inoperative position, a pressurized air source 60 provides pressurized air to a passage 62, and pressurized air is supplied from passage 62 through pressure line 40 to actuator valve 38. As shown, actuator valve 38 is biased toward a closed position so as to normally prevent passage of pressurized air therethrough to control line 42.

Pressurized air is supplied through passage 62 to a sensor 66, and to a sensor 68 through a passage 70 interconnected with passage 62. Sensors 66, 68 each include a reciprocably movable sensor piston 72, 74, respectively and sensor balls 76, 78, respectively. Broadly speaking, sensor 66 discerns the existence of any differential in pressure between pressure in line 62 and on the head of sensor piston 72 for selectively providing air pressure to a passage 80. Likewise, sensor 68 discerns the existence of any differential in pressure between line 70 and pressure on the head of sensor piston 74 for selectively providing pressure to a line 82.

A passage 84 interconnects control line 42 with a normally closed sensor control valve 86 and a normally open hydraulic control valve 88.

A passage 89 interconnects sensor control valve 86 with one end of a reciprocably movable main air valve 90, the other end of which is in communication with passage 80. A passage 91 provides pressurized air from passage 62 to main air valve 90. Depending upon the position of main air valve 90, pressurized air is supplied therethrough to either a passage 92 or a passage 94. As shown, passage 92 is in communication with the head end of an air cylinder 96 within which an air piston 98 is disposed, and passage 94 is in communication with the rod end of air cylinder 96. A passage 100 communicates air pressure from passage 92 to the head of sensor piston 74, and a passage 12 communicates air pressure from passage 94 to the head of sensor piston 72.

As shown, air piston 98 includes a head 104 and a rod 106. A portion of the length of rod 106 is disposed within a hydraulic pumping chamber 108, and a floating ring 110 is slidably mounted to the portion of rod 106 disposed within pumping chamber 108. Floating ring 110 and rod 106 are interconnected such that rightward movement of floating ring 110 causes rightward movement of piston 98 through rod 10, and leftward movement of piston 98 causes leftward movement of floating ring 110 through rod 106. The leftward side of floating ring 110 is exposed to air pressure in passage 92 through a passage 111. The rightward side of floating ring 110 is exposed to hydraulic fluid, which is communicated to hydraulic pumping chamber 108 from a hydraulic fluid reservoir 112 through a suction passage 114 within which is disposed a check valve 116, which allows one-way flow of hydraulic fluid from reservoir 112 into chamber 108.

A passage 120 communicates between air passage 84 and a pressure regulating valve 122, which communicates through a passage 124 with reservoir 112.

Hydraulic pumping chamber 108 is interconnected through a passage 126, a check valve 128 and a passage 130 with line 44, to provide fluid pressure to expander 12.

A return passage 132 is interconnected at one end with hydraulic control valve 88, and at its other end with reservoir 112. A pressure regulating valve 134 is disposed between passage 130 and return passage 132.

As shown, passages 80, 89 are in communication with opposite ends of main air valve 90. As will be explained, sensors 66, 68 selectively provide pressurized air to passages 80, 89 for providing reciprocating movement of main air valve 90. In this manner, pressurized air is selectively channeled from passage 91 through main air valve 90 to either passage 92 or passage 94.

In operation, a user depresses actuator button 36 so as to move actuator valve 38 to its open position, as shown in FIG. 4. Such movement of actuator valve 38 allows pressurized air to pass from pressure line 40 to control line 42 and into air passage 84. Pressurized air in passage 84 shifts sensor control valve 86 from its normally closed position to an open position, providing communication between passage 82 and passage 89. At the same time, pressurized air is introduced to passage 86 to shift normally open hydraulic control valve 88 to its closed position. Pressurized air in passage 84 is communicated through passage 120 and pressure regulating valve 122 so as to exert a predetermined amount of air pressure on hydraulic fluid contained within reservoir 112 through passage 124.

As noted, sensors 66, 68 control the supply of pressurized air to the ends of main air valve 90 to thereby control its position, which determines whether pressurized air is supplied to either passage 92 or 94. Briefly stated, and with reference to sensor 66, during leftward movement of air piston 98 there is a pressure differential between passages 62 and 102, with pressure in passage 62 being greater than pressure in passage 102. In this situation, the force due to pressure on ball 76 exceeds that on the head of sensor piston 74, and sensor 66 remains closed. When air piston 98 is fully retracted to its return position, pressure in passage 102 becomes equal to pressure in passage 62. In this situation, the force due to pressure on the head of sensor piston 72 exceeds the force due to pressure on ball 76 due to the greater surface area of the head of sensor piston 72. Sensor piston 72 then shifts ball 76 rightwardly, and introduces air pressure into passage 80 to shift main air control valve 90 leftwardly for introducing pressurized air to passage 92 therethrough. Pressurized air in passage 92 then moves air piston 98 rightwardly to provide a downward, or pumping, stroke. Sensor 68 then functions in a manner similar to that described above with reference to sensor 66, so that when the downward stroke of air piston 98 is completed and pressure in passages 70 and 100 is equalized, sensor piston 74 shifts ball 78 to introduce air pressure into passage 82 and through valve 86 and passage 89 to the leftward end of main air control valve 90. Valve 90 is then shifted rightwardly so as to introduce air pressure into passage 94 for providing a return stroke of air piston 98. In this manner, sensors 66, 68 provide reciprocating movement of main air control valve 90, resulting in selective introduction cf air pressure into passages 92, 94 for reciprocating air piston 98.

The supply of pressurized air to passage 92 is transferred via passage 111 to the leftward surface of floating ring 110. Floating ring 110 provides an auxiliary pumping means for delivering a relatively high flow rate of hydraulic fluid from reservoir 112 to expander 12 at a relatively low pressure to increase the speed of operation of expander 12. Floating ring 110 is mounted within hydraulic fluid pumping chamber 108 for reciprocating movement therewithin on piston rod 106. As noted, air pressure provided to passage 92 is communicated through passage 111 with the leftward surface of floating ring 110. As long as the force due to air pressure on floating ring 110 exceeds the force on floating ring 110 due to hydraulic fluid pressure resulting from the load on expander 12, air pressure on the leftward surface of floating ring 110 will cause rightward movement of floating ring 110 within chamber 108. Such rightward movement of floating ring 110 causes hydraulic fluid disposed within chamber 108 to be evacuated therefrom through passage 126. During such rightward movement of floating ring 110, flow of hydraulic fluid through line 114 into reservoir 112 is prevented by check valve 116. Hydraulic fluid pumped in this manner by rightward movement of floating ring 110 passes through check valve 128 and passage 130, and thereafter to the rod side of piston 28 through port 26 and line 44 for causing withdrawal of stem 18 therewithin, as explained previously. Pressure regulating valve 134 is interconnected between passage 130 and return passage 132 for regulating the amount of fluid pressure delivered to expander 12.

When floating ring 110 has reached its rightwardmost position within chamber 108, so that air piston 98 is likewise in its rightwardmost position, air pressure is supplied through sensor 66 to the rod side of air piston 98 for returning piston 98 to its leftwardmost position. Through a washer 142, such leftward movement of air piston 98 causes leftward movement of floating ring 110 within chamber 108. This action of floating ring 110 causes hydraulic fluid to be sucked into chamber 108 through check valve 116 and suction passage 114 from reservoir 112, filling chamber 108. Once this position is attained, sensor 66 shifts main air valve 90 leftwardly so that pressurized air is again provided to passages 92 and 111, causing another downward stroke of floating ring 110. This action continues so that hydraulic fluid is supplied to expander 12 at a relatively high flow rate and low pressure by floating ring 110 to provide rapid operation of expander 12, until the load exerted on expander 12 creates fluid pressure on rightward side of floating ring 110 resulting in a force sufficient to overcome the force exerted on the leftward side of floating ring 110 by pressurized air communicated therewith through passage 111. When this occurs, further reciprocating movement of floating ring 110 within chamber 108 is prevented. Air piston 98 continues, however, to reciprocate within air cylinder 96 due to the intermittent supply of pressurized air through passages 92 and 94. With such continued reciprocating movement of air piston 98, reciprocating movement of the end of rod 106 is continually provided which supplies a relatively high level of hydraulic pressure to expander 12 at a relatively low flow rate. The pressure so delivered by reciprocating movement of the end of rod 106 is sufficient to overcome the load exerted on expander 12 so as to expand the pipe.

When the pipe has been fully expanded, the user releases actuator button 36, thereby allowing actuator valve 38 to return to its normally closed position as shown in FIG. 3. The supply of pressurized air to reservoir 112 is then cut off, and hydraulic fluid supplied to expander 12 is exhausted therefrom by return of piston 28 to its original position by means of spring 34. Hydraulic fluid so exhausted passes through line 44 and hydraulic control valve 88 to return passage 132 and thereafter to reservoir 112.

Figure 5:
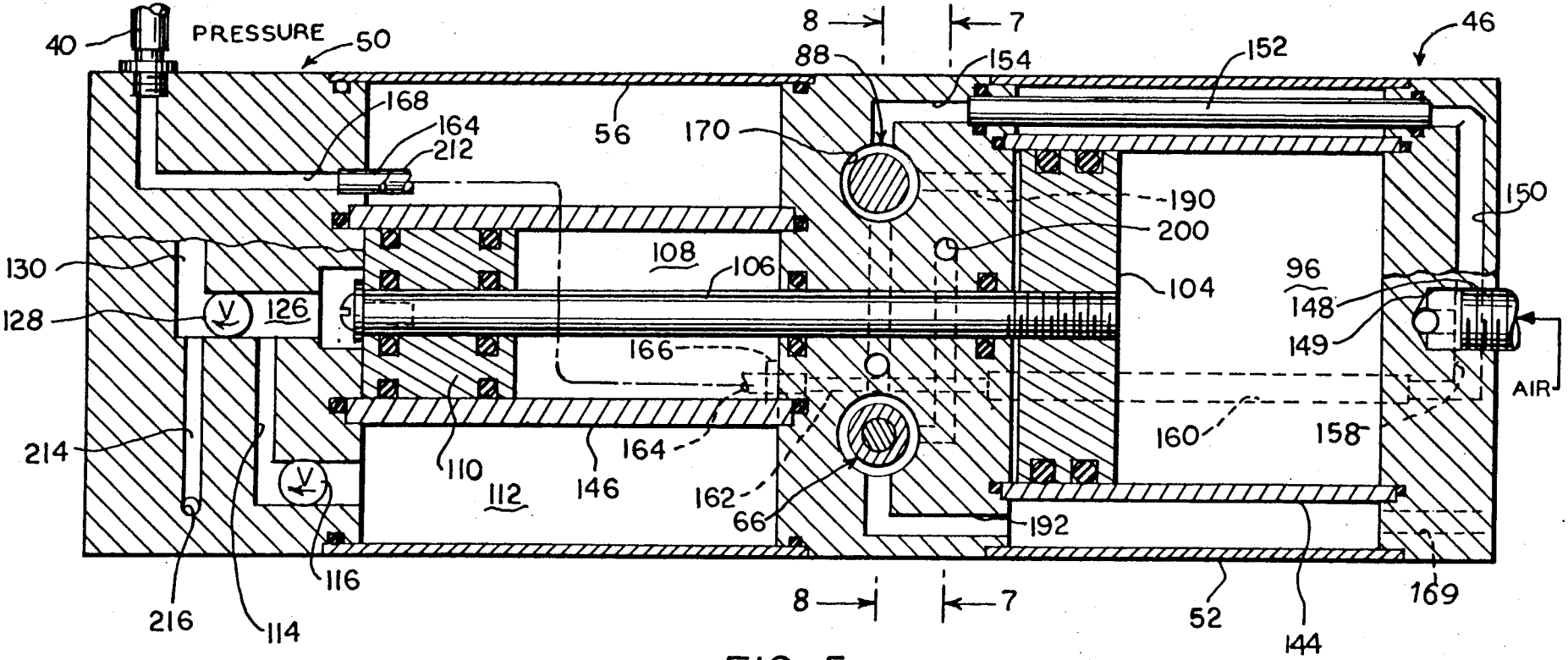
FIG. 5 is a sectional view, with portions broken away, showing the internal construction of the air-hydraulic pump of the invention.

FIGS. 5–10 illustrate details of the physical embodiment of air-hydraulic pump 10 of the invention. Where possible, like reference characters will be used in describing FIGS. 5–10 as were used in the above discussion of FIGS. 1–4. As shown in FIG. 5, an inner air tube 144 is disposed between air intake block 46 and control block 48 so as to form air cylinder 96, within which air piston 98 is disposed. Outer air tube 52 is provided between air intake block 46 and control block 48 around inner air tube 144 so as to form an annular space therebetween. In a somewhat similar manner, an inner oil tube 146 is disposed between control block 48 and hydraulic block 50 so as to form hydraulic fluid pumping chamber 108. Outer oil tube 56 is disposed between control block 48 and hydraulic block 50 around inner oil tube 146 so as to form oil reservoir 112 in the space therebetween. As shown, floating ring 110 is disposed within pumping chamber 108 and is slidably mounted to rod 106.

With further reference to FIG. 5, a fitting 148 is mounted to air intake block 46 at an opening 149 provided therein. Pressurized air is introduced to air intake block 46 through fitting 148, and passes through a passage 150 and an air tube 152 to a passage 154 in control block 48. Simultaneously, pressurized air is supplied to a passage 158 formed in air intake block 46, which communicates through a tube 160 with a passage 162 formed through control block 48. A flexible tube 164 is in communication with passage 162 through a fitting 166 for communicating pressurized air through reservoir 112 to a passage 168 formed in hydraulic block 50. Such pressurized air is then supplied to expander 12 through pressure line 40.

A vent passage 169 extends through the lower portion of air intake block 46. Vent passage 169 communicates between the exterior of air intake block 46 and the annular space between outer air tube 52 and inner air tube 144.

Figure 6:
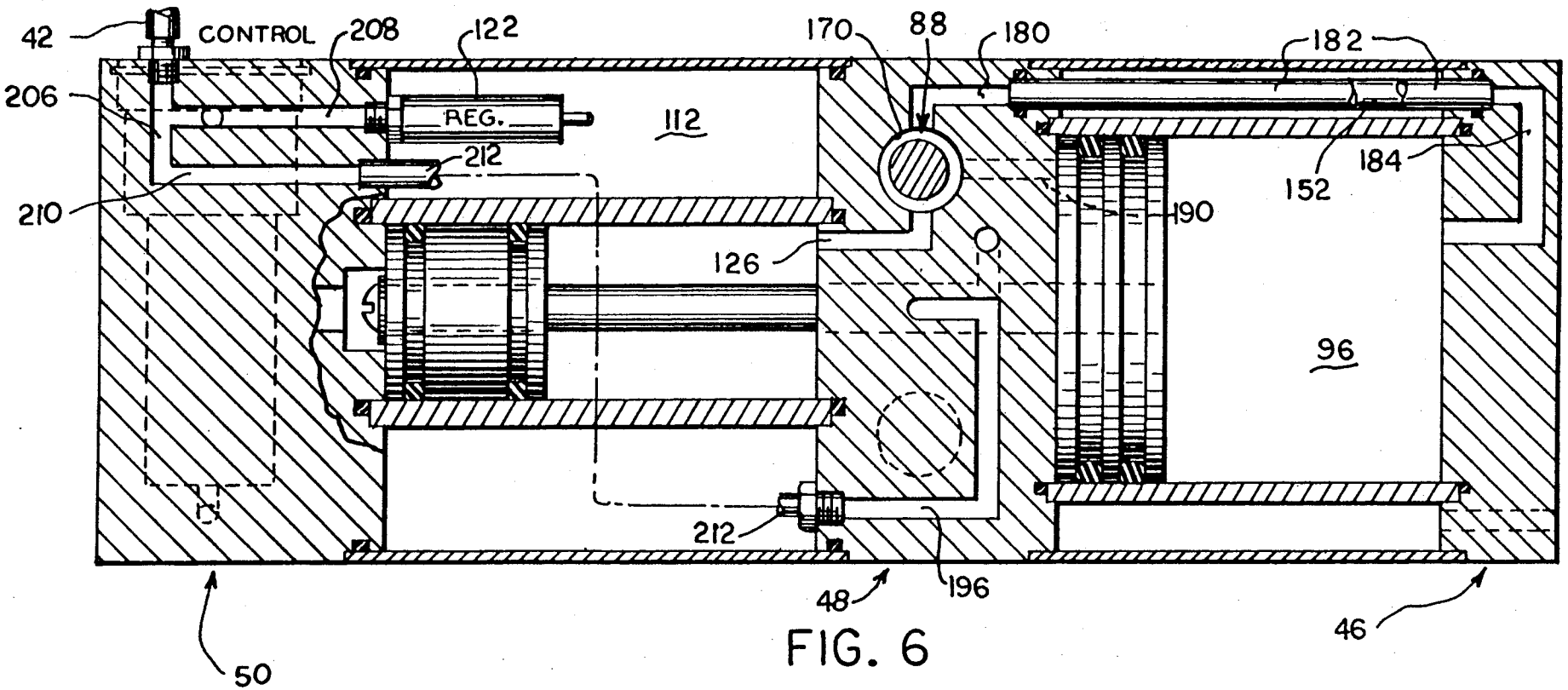
FIG. 6 is a view similar to FIG. 5 showing further internal construction of the air-hydraulic pump of the invention.
Figure 7:
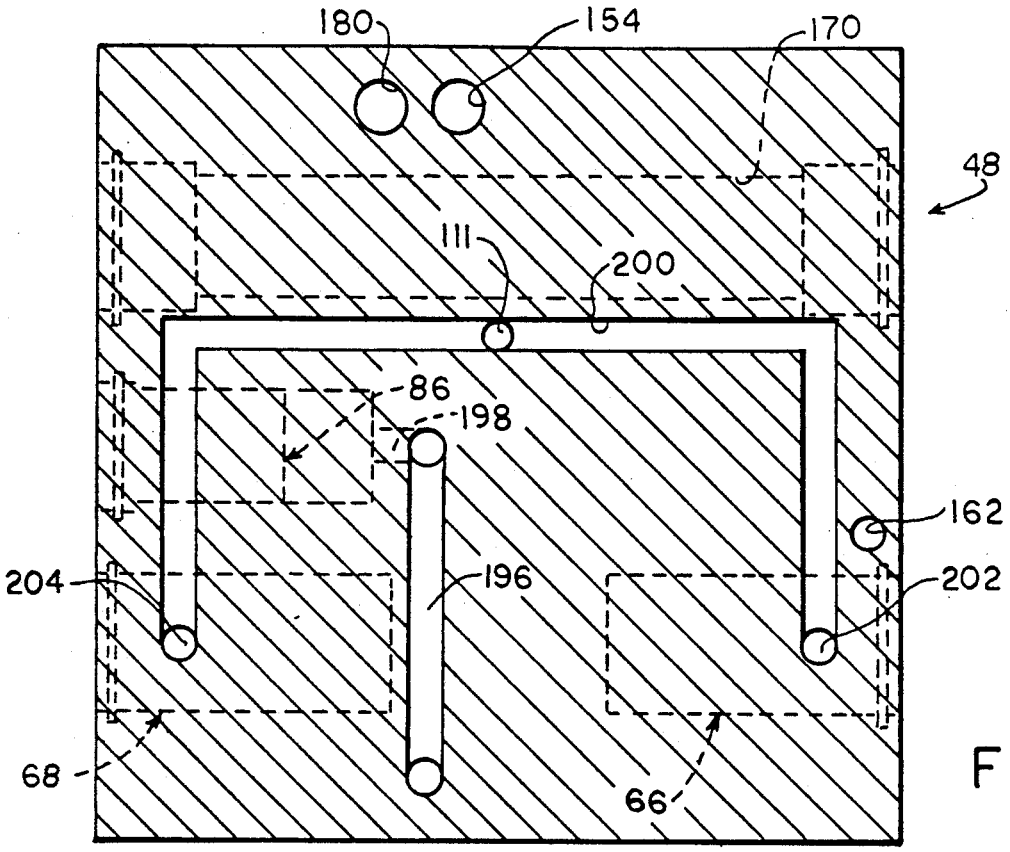
FIG. 7 is a sectional view taken generally along line 7-7 of FIG. 5.
Figure 8:
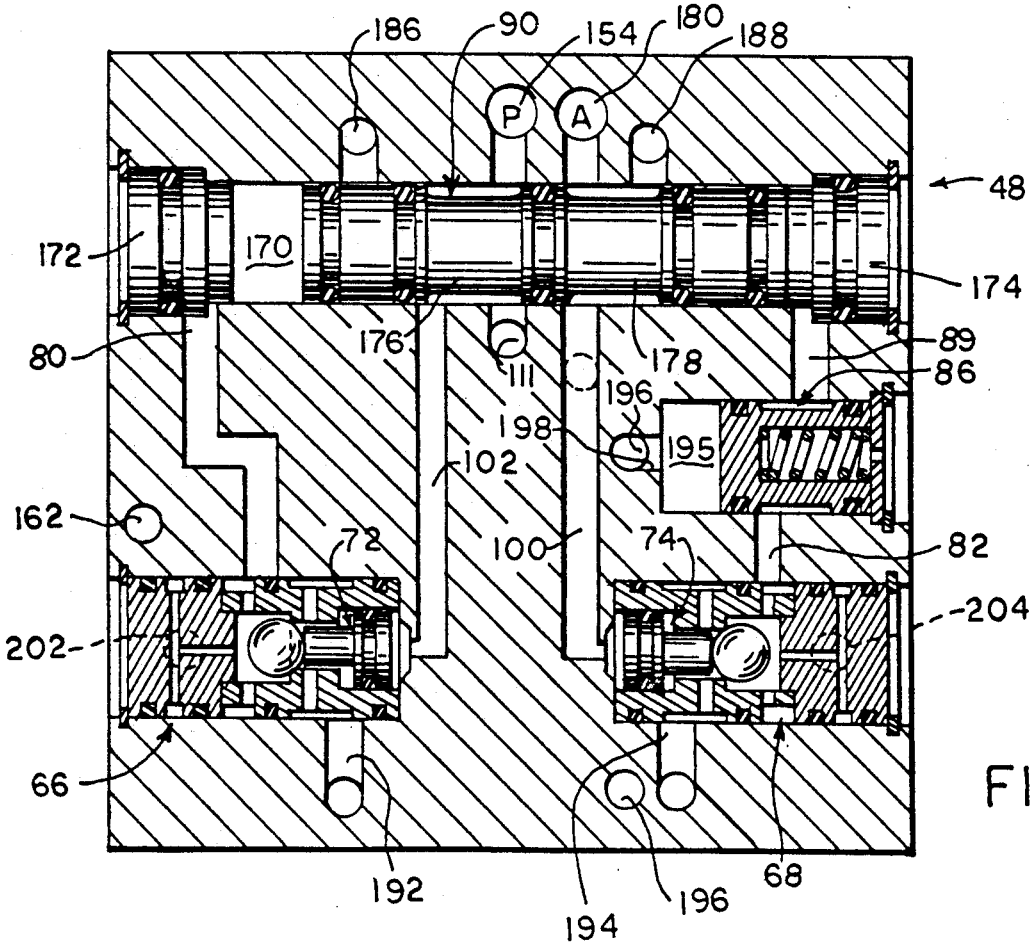
FIG. 8 is a sectional view taken generally along line 8-8 of FIG. 5.

With further reference to FIGS. 5 and 6, in conjunction with FIGS. 7 and 8, main air control valve, or spool, 90 is disposed within a main air valve passage 170 formed in control block 48. A pair of sealing plugs 172, 174 are provided at the ends of passage 170, and define an axial dimension of passage 170 greater than that of main air control valve 90. This construction allows for reciprocating movement of main air control valve 90 within passage 170. Main air control valve 90 has a centrally disposed pair of areas of reduced diameter 176, 178, each of which is sealed by O-rings fitted within grooves provided in main air control valve 90 which engage the walls of passage 170.

A series of air passages are formed in control block 48 in communication with main air control valve passage 170. Passage 154 communicates pressurized air to main air control valve 90 from air intake block 46. A passage 180 (FIG. 6) communicates between main air control valve 90 and an air tube 182, which communicates with a passage 184 formed in air intake block 46 which opens into the interior of air cylinder 96. A pair of exhaust passages 186, 188 (FIG. 8) communicate between main air control valve 90 and the annular space between inner and outer air tubes 52, 144. A passage 190 (FIG. 6) extends from main air control valve 90 and opens into the interior of air cylinder 96. Passage 80 extends between sensor 66 and the leftward end of main air control valve 90. Passage 82 extends between sensor 68 and sensor control valve 86, and passage 89 extends from sensor control valve 86 to communicate with the rightward end of main air control valve 90. Passage 102 (FIG. 8) interconnects main air control valve 90 with the head of sensor piston 72 associated with sensor 66, and passage 100 interconnects main air control valve 90 with the head of sensor piston 74 associated with sensor 66.

A sensor exhaust passage 192 (FIG. 8) interconnects sensor 66 with the annular space between inner and outer air tubes 52, 144, and a sensor exhaust passage 194 likewise interconnects sensor 68 therewith.

As shown in FIG. 8, sensor control valve 86 is disposed within a passage 195 formed in control block 48. A passage 196 (FIGS. 6, 7, 8) communicates control pressure to a passage 198 for introducing pressure to sensor control valve passage 195 and for shifting sensor control valve 86 to its open position in response thereto.

With reference to FIGS. 7 and 8, a passage 200 communicates with passage 111. One trunk of passage 200 communicates with a passage 202 for pressurizing the ball end of sensor 66, and the other trunk of passage 200 communicates with a passage 204 for pressurizing the ball end of sensor 68.

When actuator button 36 is depressed so as to move actuator valve 38 to its open position, pressurized air returns to hydraulic block 50 through control line 42 (FIG. 6), which communicates with a passage 206 formed in hydraulic housing 50 for providing air pressure through a passage 208 to pressure regulating valve 122 for providing fluid pressure to oil contained in reservoir 112. Control air pressure is simultaneously communicated through a passage 210 to a tube 212 which communicates with passage 178 formed in control block 48 for supplying pressurized air to sensor control valve 86 to move sensor control valve 86 to its open position (FIG. 8) for interconnecting passages 82 and 90. As noted, pressurized air is simultaneously supplied to the ball ends of sensors 66, 68.

Figure 9:
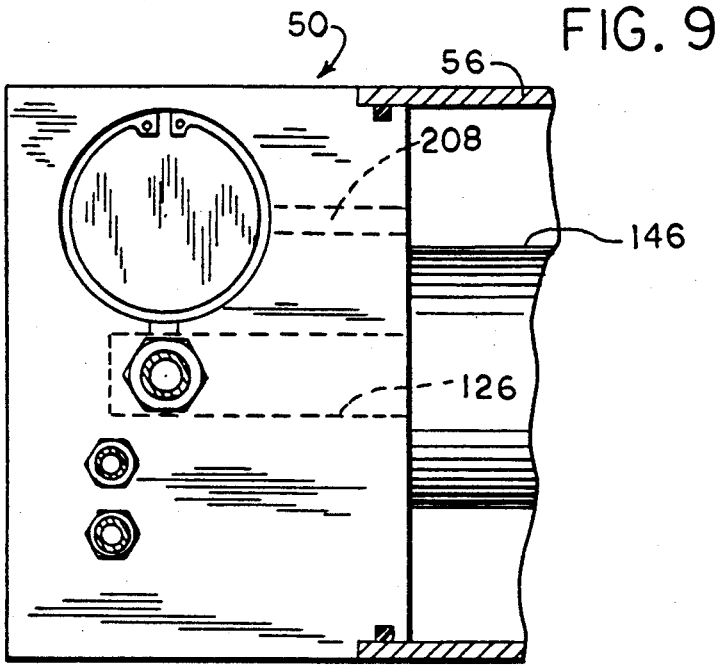
FIG. 9 is a top elevation view of the hydraulic housing of the invention.
Figure 10:
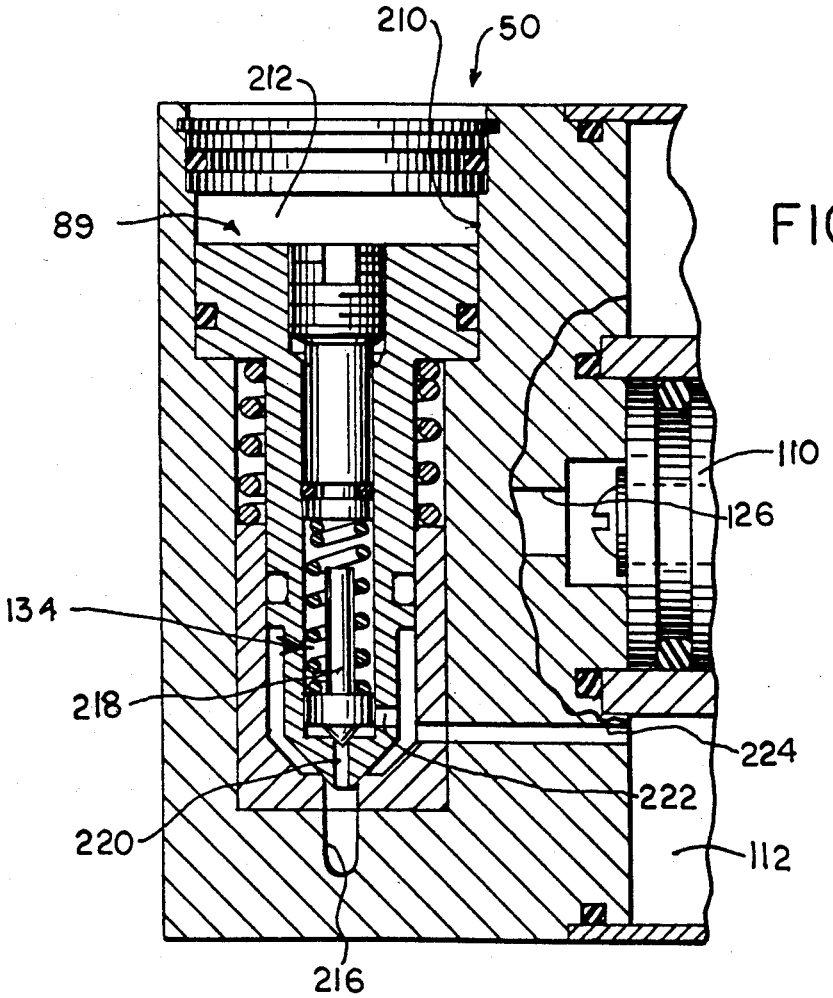
FIG. 10 is a partial sectional view, with portions broken away, of the hydraulic housing of the invention.

With reference to FIGS. 5, 9 and 10, hydraulic control valve 88 is mounted within a passage 210 formed in hydraulic housing 50. A cavity 212 adjacent the upper end of hydraulic control valve 89 is exposed to pressurized air when actuator valve 38 is opened, for moving hydraulic control valve 89 to its closed position as shown in FIG. 10.

Opening of actuator valve 38 introduces air pressure to control block 48 through its various passages, and sensors 66, 68 act to selectively provide such pressurized air through passages 80, 89 to the ends of main air control valve 90 for providing reciprocating movement thereof. Such movement of main air control valve 90 selectively provides pressurized air to passages 80, 89. When the load on the system is low, pressurized air is supplied to floating ring 110 for providing a relatively high flow rate at low pressure. When the load on the system exceeds a predetermined level, the supply of pressurized air to floating ring 110 is cut off, and such air is supplied to the opposite faces of piston head 104. Fluid is then pumped solely by the action of piston rod 106.

Hydraulic fluid is pumped through passage 126 in hydraulic block 50, and through check valve 128 to passage 130 for supply therethrough to hydraulic line 44. Simultaneously, fluid pressure is provided in a passage 214 (FIG. 5), which communicates through a passage 216 (FIGS. 5, 10) with the lower end of hydraulic control valve 89. As long as pressure in passage 130 is at or below a level determined by pressure relief valve 134, a poppet 218 (FIG. 10) associated with pressure relief valve 134, remains seated. When pressure in passage 130 exceeds the predetermined level, relief poppet 218 unseats so as to expose passage 216 to reservoir 112 through passages 220, 222 in hydraulic control valve 89 and passage 224 in hydraulic block 50. With this construction, a constant predetermined pressure is supplied to expander 12.

With the construction of air-hydraulic pump 10 as described, it is seen that an extremely compact and efficient construction is provided, while substantially improving the performance and efficiency of such a unit.

Various alternatives and modifications are contemplated as being within the scope of the following claims particularly pointing out and distinctly claiming the subject matter regarded as the invention.

I claim:

1. A pressurized air hydraulic fluid pump for use in a hydraulic system, comprising:

a pump body;

air supply means for providing pressurized air to said pump body;

air operated control means associated with said pump body and operable by pressurized air provided to said pump body;

a first pumping member movably mounted to said body and responsive to said control means for delivering a first level of hydraulic pressure to said system at a first flow rate; and an auxiliary pumping member movably mounted to said body and being responsive to said control means for delivering hydraulic pressure to said system at a second level less than said first level and at a second flow rate greater than said first flow rate, said auxiliary pumping member being responsive to the load on said system such that, when the load on said system exceeds a predetermined level, said auxiliary pumping member ceases operation and said first pumping member supplies pressure to said system;

wherein said first pumping member is mounted to said pump body for movement independent of said auxiliary pumping member after said auxiliary pumping member ceases operation, for delivering said first level of pressure to said system.

2. The pressurized air hydraulic fluid pump of claim 1, wherein said first pumping member comprises a reciprocating piston including a rod and a head having a pair of faces, and wherein pressurized air through said operated control means causes reciprocating movement of said piston head resulting in reciprocating movement of the end of said rod, which acts on hydraulic fluid to deliver said first level of hydraulic pressure at said first flow rate.

3. A pressurized air hydraulic fluid pump for use in a hydraulic system, comprising:

a pump body;

air supply means for providing pressurized air to said pump body;

air operated control means associated with said pump body and operable by pressurized air provided to said pump body;

first pumping means responsive to said control means for delivering a first level of hydraulic pressure to said system at a first flow rate, comprising a reciprocating piston including a rod and a head having a pair of faces, and wherein pressurized air through said air operated control means causes reciprocating movement of said piston head resulting in reciprocating movement of the end of said rod, which acts on hydraulic fluid to deliver said first level of hydraulic pressure at said first flow rate; and auxiliary pumping means responsive to said control means for delivering hydraulic pressure to said system at a second level less than said first level and at a second flow rate greater than said first flow rate, said auxiliary pumping means being responsive to the load on said system such that, when the load on said system exceeds a predetermined level, said auxiliary pumping means ceases operation and said first pumping means supplies pressure to said system, wherein said auxiliary pumping means comprises a floating ring slidably mounted to said piston rod, said ring including a hydraulic fluid contact surface greater than that provided by the end of said piston rod and a surface exposed to pressurized air through said air operated control means.

4. The pressurized air hydraulic fluid pump of claim 3, wherein said air operated control means causes reciprocating movement of said floating ring up to a predetermined level of load on said system, said predetermined load exerting hydraulic pressure on the hydraulic fluid contact surface of said ring sufficient to prevent further reciprocating movement of said ring by overcoming air pressure exerted on the surface of said ring exposed to pressurized air through said control means, whereafter the end of said reciprocating piston rod acts on hydraulic fluid to deliver said first level of hydraulic pressure to said system at said first flow rate.

5. The pressurized air hydraulic fluid pump of claim 3, wherein said air operated control means comprises:

sensing means for sensing air pressure on the faces of said piston head and on the surface of said floating ring exposed to pressurized air; and means responsive to said sensing means for selectively providing pressurized air to said piston head faces and the surface of said floating ring exposed to pressurized air for providing reciprocating movement of said piston for operating said primary and auxiliary pumping means.

6. The pressurized air hydraulic fluid pump of claim 5, wherein said means responsive to said sensing means comprises:

a spool mounted for reciprocable movement within a spool passage provided in a housing: and passage means associated with said housing in communication with said spool passage;

wherein said sensing means causes reciprocating movement of said spool within said spool passage for selectively providing pressurized air through said passage means to said piston head faces and the surface of said floating ring exposed to pressurized air.

7. In a pressurized air hydraulic fluid pump including a pump body; air supply mans for providing pressurized air to said pump body; air operated control means associated with said pump body and operable in response to pressurized air provided to said pump body; and first pumping means movably mounted to said pump body and responsive to said control means for delivering a first level of hydraulic pressure to said system at a first flow rate, the improvement comprising an auxiliary pumping member movably mounted to said pump body and being responsive to said control means for delivering hydraulic pressure to said system at a second level less than said first level and at a second flow rate greater than said first flow rate, said auxiliary pumping member being responsive to the load on said system such that, when the load on said system exceeds a predetermined level, said auxiliary pumping member ceases operation and said first pumping means being mounted to said pump body for movement independent of supplies perssure to said system, said first pumping means said auxiliary pumping member so that, after said auxiliary pumping member ceases operation, said first pumping means continues operation for delivering said first level of pressure to said system.

8. An apparatus for selectively providing hydraulic fluid pressure in a hydraulic system in response to a supply of air pressure, comprising:

an air intake block for receiving a supply of pressurized air;

a control block spaced from said air intake block;

a hydraulic block spaced from said control block;

means defining a first cavity in the space between said intake block and said control block;

means defining a second cavity in the space between said control block and said hydraulic block;

means for communicating pressurized air from said intake block to said control block;

control means disposed within said control block operable by pressurized air communicated to said control block;

actuator means for selectively providing pressurized air to said control block;

a first member mounted for reciprocating movement within said first cavity in response to pressurized air supplied through said control means;

hydraulic fluid supply means for providing hydraulic fluid to said second cavity;

primary pumping means disposed within said second cavity and responsive to reciprocating movement of said first member for delivering a first level of fluid pressure to said system at a first flow rate; and load sensitive auxiliary pumping means disposed within said second cavity for delivering a second level of fluid pressure to said system less than said first level and at a flow rate greater than said first flow rate;

wherein, through said control means, said pressurized air causes reciprocating movement of said first member within said first cavity resulting in pumping of fluid by both said primary and auxiliary pumping means up to a predetermined load on said system, whereafter said auxiliary pumping means ceases operation due to the load on said system and said primary pumping means supplies pressure to said system.

9. The apparatus of claim 8, wherein said means defining said first cavity comprises a first tubular member disposed between said air intake block and said control block, with one end of said first tubular member abutting said air intake block and the other end of said first tubular member abutting said control block.

10. The apparatus of claim 9, wherein said first member mounted for reciprocating movement within said first cavity comprises a piston having a head portion disposed within the interior of said tubular member, said piston head portion providing a pair of faces selectively exposed to pressurized air through said control means for providing reciprocating movement thereof.

11. The apparatus of claim 10, wherein said primary pumping means comprises a rod interconnected with said piston head such that reciprocating movement of said piston head causes reciprocating movement of an end of said rod for delivering said first level of fluid pressure to said system at said first flow rate.

12. The apparatus of claim 11, wherein said means defining a second cavity comprises a second tubular member disposed between said control block and said hydraulic block, with one end of said second tubular member abutting said control block and the other end of said second tubular member abutting said hydraulic block.

13. The apparatus of claim 12, wherein a portion of the length of said rod is disposed in the interior of said second tubular member, and wherein said auxiliary pumping means comprises a floating ring slidably mounted to the portion of said rod disposed within the interior of said second tubular member, said floating ring having a fluid contact surface greater than that provided by the end of said rod and a surface exposed to pressurized air through said control means.

14. The apparatus of claim 13, wherein engagement means is provided between said floating ring and said rod so that, when the force caused by air pressure on the surface of said floating ring exposed to air pressure exceeds the force caused by hydraulic fluid pressure on the fluid contact surface of said ring, said floating ring is caused to move within the interior of said second tubular member in a first direction and to move said rod and piston head therewith to provide a pumping stroke, with a return stroke provided by pressurized air acting through said control means on a face of said piston for moving said piston head and rod in a second direction, resulting in movement of said floating ring in said second direction through said engagement means.

15. The apparatus of claim 12, wherein said hydraulic fluid supply means comprises a reservoir provided about the exterior of said second tubular member between said control block and said hydraulic block, said reservoir being in communication with said hydraulic block for supplying hydraulic fluid thereto.

16. The apparatus of claim 13, wherein said control means comprises:

sensing means for sensing air pressure on the faces of said piston head and on the surface of said floating ring exposed to pressurized air; and means responsive to said sensing means for selectively providing pressurized air to said piston head faces and the surface of said floating ring exposed to pressurized air for providing reciprocating movement of said piston for operating said primary and auxiliary pumping means.

17. The apparatus of claim 16, wherein said means responsive to said sensing means comprises:

a spool mounted for reciprocable movement within a spool passage provided in a housing; and passage means associated with said housing in communication with said spool passage;

wherein said sensing means causes reciprocating movement of said spool within said spool passage for selectively providing pressurized air through said passage means to said piston head faces and the surface of said floating ring exposed to pressurized air.

* * * * *